US005901991A

United States Patent [19]

Hugel et al.

[11] Patent Number: 5,901,991

[45] Date of Patent: May 11, 1999

[54] PROCESS FOR TRIGGERING AN ELECTRICALLY ACTUATED MOTOR VEHICLE DOOR LOCK OR THE LIKE

[75] Inventors: Robert Hugel, Karksruhe; Piotr Szablewski, Wuppertal, both of Germany

[73] Assignee: Robert Bosch GmbH, Stuttgart, Germany

[21] Appl. No.: 08/861,014

[22] Filed: May 21, 1997

[30] Foreign Application Priority Data

| | | | |
|---|---|---|---|
| May 30, 1996 | [DE] | Germany | 196 23 165 |
| May 21, 1996 | [DE] | Germany | 196 20 256 |
| Aug. 16, 1996 | [DE] | Germany | 196 32 915 |

[51] Int. Cl.[6] ..... E05C 3/06

[52] U.S. Cl. ..... 292/201; 292/216; 292/336.3; 292/DIG. 23

[58] Field of Search ..... 292/201, 216, 292/DIG. 23, 336.3; 70/256, 257

[56] References Cited

U.S. PATENT DOCUMENTS

| | | | |
|---|---|---|---|
| 4,624,491 | 11/1986 | Vincent | 292/201 |
| 4,667,990 | 5/1987 | Quantz | 292/216 |
| 4,976,477 | 12/1990 | Nakao | 292/201 |
| 4,978,153 | 12/1990 | Hirsh et al. | 292/216 |
| 4,995,651 | 2/1991 | Wardlaw | 292/201 |
| 5,713,613 | 2/1998 | Honma et al. | 292/201 |
| 5,746,076 | 5/1998 | Inoue | 292/201 |

FOREIGN PATENT DOCUMENTS

| | | |
|---|---|---|
| 0 589 158 | 3/1994 | European Pat. Off. . |
| 32 42 527 | 5/1984 | Germany . |
| 36 26 441 | 9/1987 | Germany . |
| 2206638 | 1/1989 | United Kingdom . |

*Primary Examiner*—Suzanne Dino Barrett
*Assistant Examiner*—Teri Pham
*Attorney, Agent, or Firm*—Sixbey, Friedman, Leedom & Ferguson; David S. Safran

[57] ABSTRACT

A process for triggering a electrically actuated motor vehicle door lock by a mechanical or electromechanical actuating handle. In this process, triggering takes place such that the electric motor drive always returns to an initial rest position after initial triggering and that actuation of the actuating handle for less than a minimum time does not trigger a switching function. Thus misactuations are unlikely. The operating characteristics of the motor vehicle door lock which is controlled using this process is matched as much as possible to the operating characteristics of mechanical or electromechanical motor vehicle door locks of conventional design. This facilitates acceptance among customers and prevents misoperations.

17 Claims, 4 Drawing Sheets

PROCESS FOR TRIGGERING AN ELECTRICALLY ACTUATED MOTOR VEHICLE DOOR LOCK OR THE LIKE

BACKGROUND OF THE INVENTION

1. Field of the Invention

The invention relates to a process for triggering an electrically actuated motor vehicle door lock or the like, which is actuated electrically from a mechanical or electromechanical actuating handle. More specifically, to the triggering of a motor vehicle door lock in a largely closed external housing having a latch, made preferably as rotary latch, and having a detent pawl which keeps the rotary latch in the closed position, an electric drive for the detent pawl, the detent pawl being raisable off of the catch of rotary latch by the drive, and having microswitches which indicate the position of the detent pawl and the position or actuation state of the actuating handle. The invention also relates to the corresponding circuits for performing the process.

2. Description of Related Art

A related process is known for a motor vehicle side door lock, which in principle can also be used for trunk lid locks and tailgate locks. The prior art (published German Application 32 42 527) is characterized by an extensive electric motor drive, by which both the latch and the detent pawl are driven, the latch in the sense of a locking aid, and the detent pawl in the sense of electric motor triggering. The prior art specifically shows only a single electric drive motor which can be drive-coupled both to the latch (in one direction of rotation) and also to the detent pawl (in the other direction of rotation) via a self-locking, step-down gearing which works in two directions of action. Only the triggering of the electric motor drive in its relation to the detent pawl is of interest relative to this invention.

In the noted prior art, the latch is provided with a double lock-in position that is conventional for side door locks, and specifically, is made as a fork latch with a front catch on the leading fork latch leg and a main catch on the following fork latch leg. The latch is held both in the front latch position and also in the main latch position by the detent pawl which is tension-loaded with a corresponding catch projection. The detent pawl is supported on a bearing axle and is made with two arms, the second arm of the detent pawl pointing away from the catch projection having an actuation surface.

The electric motor drive has a drive element made as a pinion to which a driver in the form of a cam disk is attached with a stop edge which thus forms an eccentric driver. This drive element can only be rotated in one direction, and therefore is not reset, but always returns to its original position again as it continues to turn in the direction of rotation. By turning the drive element in the lifting and turning direction, the driver strikes the actuating surface of the detent pawl and lifts the catch projection of the detent pawl off the main catch of the rotary latch.

In the aforementioned prior art, starting of the electric drive from. the initial position (readiness position) is triggered by actuating a handle, for example, an exterior door handle, and this actuation switches a microswitch. After the detent pawl has been successfully raised off the main catch by means of the driver, the driver strikes another microswitch and turns off the electric motor drive again. The detent pawl thus remains in the lifted position. In this way, the rotary latch can reach its open position unhindered by the detent pawl and the detent pawl, therefore, does not drop into the front catch of the rotary latch. This state lasts until the handle is again released. Release of the handle switches the microswitch again, which thus turns on the electric motor drive again. The cam disk which forms the driver continues to turn into its initial position (readiness position) in which the detent pawl falls back again or comes to rest on the leading fork latch leg under reset spring force. When the motor vehicle door or lid is closed the detent pawl can, therefore, drop into the front catch on the latch again under spring force.

The above explanation illustrates that the proper function of keeping the detent pawl open presupposes positive actuation of the handle by an individual. When an individual releases the handle before the rotary latch has reached the open position, it can happen that the detent pawl drops into the front catch of the rotary latch, although the door or lid is not yet open. This is not a problem in this type of drive engineering since further pulling on the handle allows the trigger cycle for the detent pawl to be repeated.

A more modern version of this electrically actuated motor vehicle door lock is known (published European Patent Application 0 589 158) in which lifting of the detent pawl is caused via a small electric drive in an otherwise largely closed external housing, especially via a solenoid. Triggering takes place from a mechanical or electronic actuating handle (handle or remote control) using various microswitches, among others; these rnicroswitches are used for scanning the position of the detent pawl and the position of the drive. Here, complete integration of the construction in the small external housing of the motor vehicle door lock is obtained, as is fully electronic triggering with control logic.

In the aforementioned triggering of an electrically actuated motor vehicle door lock with a solenoid as the drive of the detent pawl, the problem of the detent pawl dropping again can be solved relatively easily by a corresponding triggering of the solenoid, if specifically the rotary motion of the rotary latch is scanned until the open position is reached. This is also provided here. Consideration of this "snow load function" is of varied importance in different applications.

The above explained motor vehicle door locks or the like operate with microswitches for triggering. The use of microswitches and self-locking drives which run in one direction has the advantage that energy is only consumed when it is actually needed. The electric drive motor does not run into a block in order to be turned off by the then detected increase of the supply current. The electric motor drive need not operate against the force of a return spring either. Very low operating voltages can be used and power supply voltages of a few volts are sufficient. The gearing is protected since stops need not be struck. For this reason, as before, the use of microswitches for triggering generic motor vehicle door locks is quite popular. Here, it is not overlooked that microswitches can be a problem now and then with respect to their operating reliability.

In the above explained known process, user-friendliness is always a special concern. Processes for triggering electrically actuated motor vehicle door locks should proceed as much as possible such that an operator or user can act essentially as before, as is customary from the operation of mechanical or electromechanical motor vehicle door locks of the conventional type. To this extent, however, there is the problem that the known processes are not yet optimized with respect to user friendliness.

SUMMARY OF THE INVENTION

The present invention, therefore, has as a primary object the improvement of the user friendliness of process for electrically actuated motor vehicle door locks.

The object is achieved in accordance with the present invention by having triggering take place such that drive always returns to its readiness position after initial triggering, and that actuation of the actuating handle for less than a predetermined minimum time does not trigger the switching function.

According to the invention, it has been recognized, first, that the motor vehicle door lock must be operated such that the drive always returns to its readiness position after initial triggering. This is not the case in the known approach when the actuating handle is actuated for too short a time. The teaching of this invention, however, goes a step further and takes into account extremely short actuation of the actuating handle below a minimum time of 25 ms, for example. Then, it is provided that no switching function at all is triggered. The delay circuit used makes it possible to eliminate these short actuations of the actuating handle as misactuations.

The teaching of the invention makes it possible for the operating characteristics of the motor vehicle door lock which is controlled using this process to be adapted as much as possible to the operating characteristics of mechanical or electromechanical motor vehicle door locks of conventional design. This facilitates acceptance among customers, prevents misoperations, and is very feasible in case of panic because the customer is accustomed to it.

The teaching of this patent application also indicates how the circuits which implement the process according to the invention can be constructed.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
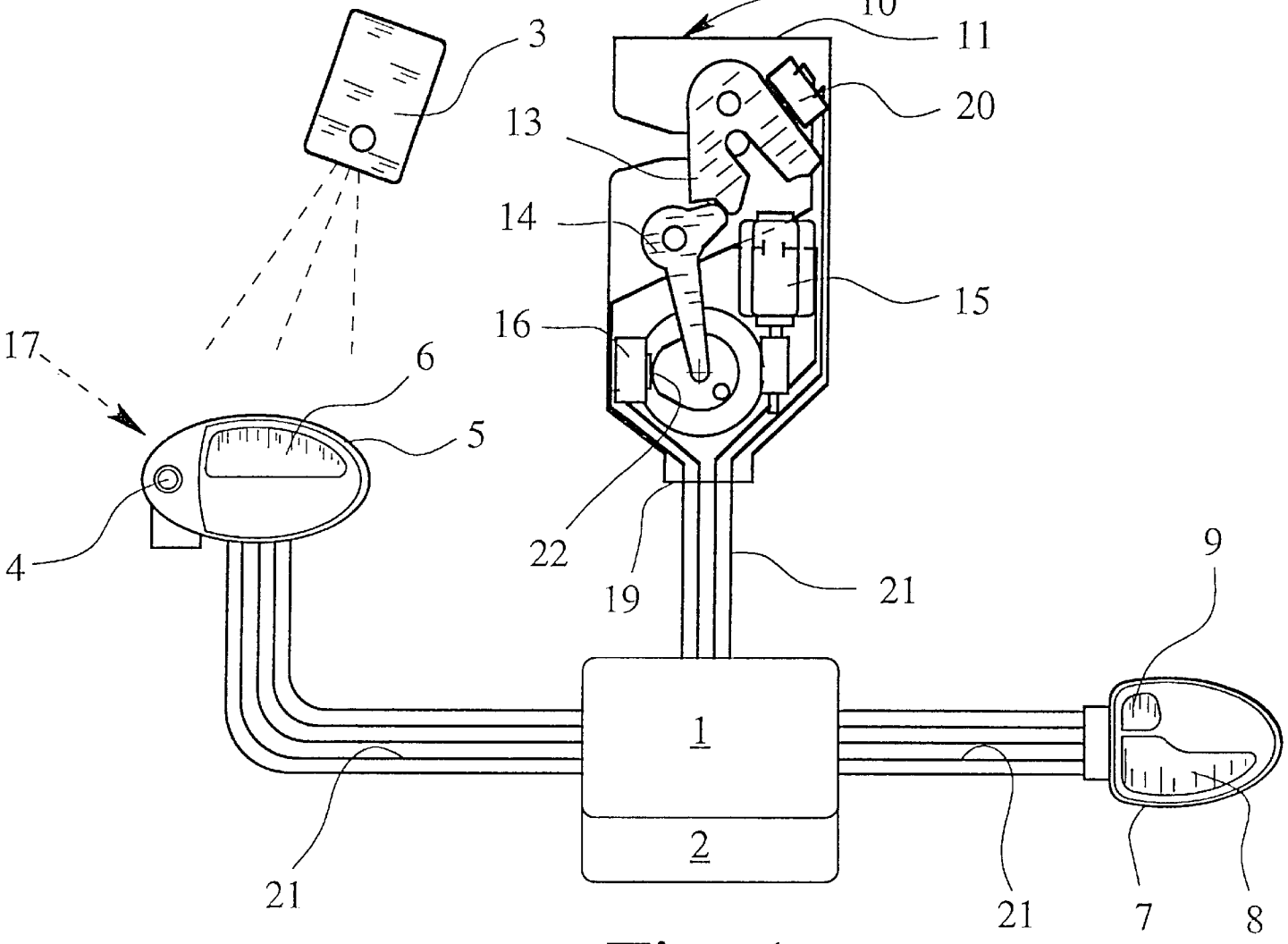
FIG. 1 shows a schematic illustration of a door locking system with a motor vehicle door lock to which the present invention is directed.

FIG. 1 shows a largely electronically controlled closing and central locking system for a motor vehicle. Central control electronics 1 of this locking system are supplied with power by the motor vehicle battery (not shown) but, in the embodiment shown, additional reserve battery 2 or another electrical energy storage is provided for emergency actuation, so that even when the motor vehicle electrical system fails, for example, during an accident, the lock system remains operational. A portable sending module 3 which, for example, is carried by the driver (electronic key/smart card) transmits control signals which proceed to a receiver 4 on an exterior door handle 5 on the motor vehicle chassis. Receiver 4 is connected to control electronics 1. The exterior door handle 5 has a handle depression 6 and transmits only an electronic control signal to control electronics 1, so that it represents a mechanical or electrical actuating handle but there are no longer any mechanical connections. In the same way, only electrical signals are generated by the interior door handle 7, via corresponding microswitches, and are transmitted to control electronics 1. In the embodiment shown, from handle depression 8, an opening signal and optionally also a release signal, and from protection feeler probe 9 a locking signal are transmitted.

Actual motor vehicle door lock 10, which can also be a rear door or tailgate lock, has very few mechanical parts. First of all, it has an external housing 11 that is closed on all sides, and which, as is conventional, is made of plastic, for example, of two half shells which are sealed together. External housing 11 has an inlet slot for a closing hinge (not shown). A latch in the form of a rotary latch 13 and which is located in housing 11, moves in the inlet slot. This latch is kept in the closed position by a detent pawl 14 located in housing 11. An electric drive 15 is also provided in the external housing 11. This electric drive 15 causes the detent pawl 14 to be lifted off of the rotary latch 13 for purposes of opening of door lock 10.

A first microswitch is a detent pawl switch 16 which indicates the position of detent pawl 14. On the exterior door handle 5 is a handle switch 17 which indicates the position of the actuating handle or its influence state. Finally, another microswitch is provided which scans the position of rotary latch 13 as a rotary latch switch 20.

On the outside of the housing 11 is an electrical connection means 19 for the electrical terminals. It can be provided that all printed conductors for electrical connection means 19 are cast into the material of housing 11, which is usually plastic, as is known in the prior art. In any case, electrical connection means 19 can be connected with the control electronics 1 via a corresponding electrical interconnecting cable 21 or a corresponding bus system. It is also easily possible to assign decentralized control electronics 1 to each of the motor vehicle door locks 10 of the motor vehicle closing system and to install centralized control electronics.

Moreover, FIG. 1 illustrates that the detent pawl switch 16 scans the position of a cam 22 or the like which raises detent pawl 14, and not the position of the detent pawl itself. Therefore, detent pawl 14 can, for example, as the rotary latch continues to open, be raised by coming to rest on one rotary latch leg while cam 22 or the like has already moved on. The position of cam 22 is determined by detent pawl switch 16 in the preferred embodiment, so that actuation of detent pawl switch 16 after initially raising detent pawl 14 is independent of the actual position of detent pawl 14.

It is important for the teaching of the invention that triggering take place such that drive 15, after initial triggering, returns to its readiness position and that actuation of actuating handle 5 for less than a minimum time $t_{min}$ does not trigger a switching function.

With consideration of ergonomic requirements which indicate that actuating times of 100 ms are perceived as too long, it has been ascertained that the minimum time $t_{min}$ should be roughly 15 to 40 ms, preferably roughly 25 ms.

In principle, it applies that any actuation of actuating handle 5 below the minimum time $t_{min}$ cannot trigger a switching function. This means that the minimum time when pulling the handle 5 and also when releasing actuating handle 5. The preferred embodiment shown illustrates that the actuation of actuating handle 5 in only one direction below the minimum time $t_{min}$ does not trigger a switching function, especially only the first actuation. Then, the minimum time $t_{min}$ does not occur in between at locations where no longer required.

Because in the embodiment shown detent pawl switch 16 does not scan the actual position of detent pawl 14 itself, but the position of cam 22, detent pawl switch 16 itself can be used for the switch signal when the readiness position is reached.

Alternatively, it is also possible for the readiness position of the drive 15 to be scanned independently of detent pawl switch 16 when using an additional switch, specifically a readiness position switch 18. This makes it possible for detent pawl 16 to scan the actual position of detent pawl 14 if this should be desirable for some reason.

One example of a circuit for implementing the above described process will be described using FIG. 2.

The embodiment shown illustrates that rotary latch switch 20 is present. However, this is not necessarily so; rotary latch switch 20 is optional.

The embodiment shown further illustrates, using broken lines, that under certain circumstances there can be an additional readiness position switch 18 which is switched when drive 15 reaches the readiness or rest position.

A control logic 23 is connected not only to the terminals for the power supply voltage (+) and ground (−) in the embodiment shown, but also to the following terminals in the system:

Terminal A1 to rotary latch switch 20,

Terminal A2 to detent pawl switch 16,

Terminal A3 for power supply to drive 15,

Terminal A5 to the output pole of handle switch 17,

Terminal A6 to the negative pole of handle switch 17,

Terminal A7 to the positive pole of handle switch 17.

The embodiment shown, without being restrictive, illustrates that when the actuating handle 5 is not actuated, handle switch 17 connects terminals A5, A6, when actuating handle 5 handle is actuated however it connects terminals A5 and A7.

Otherwise, scanning is done on terminals A1, A2 (and optionally A4) with the possibilities of a "0" and a "−" signal; for terminal A3 power is supplied with "+" or a rest position is assumed with "−".

Figure 3:
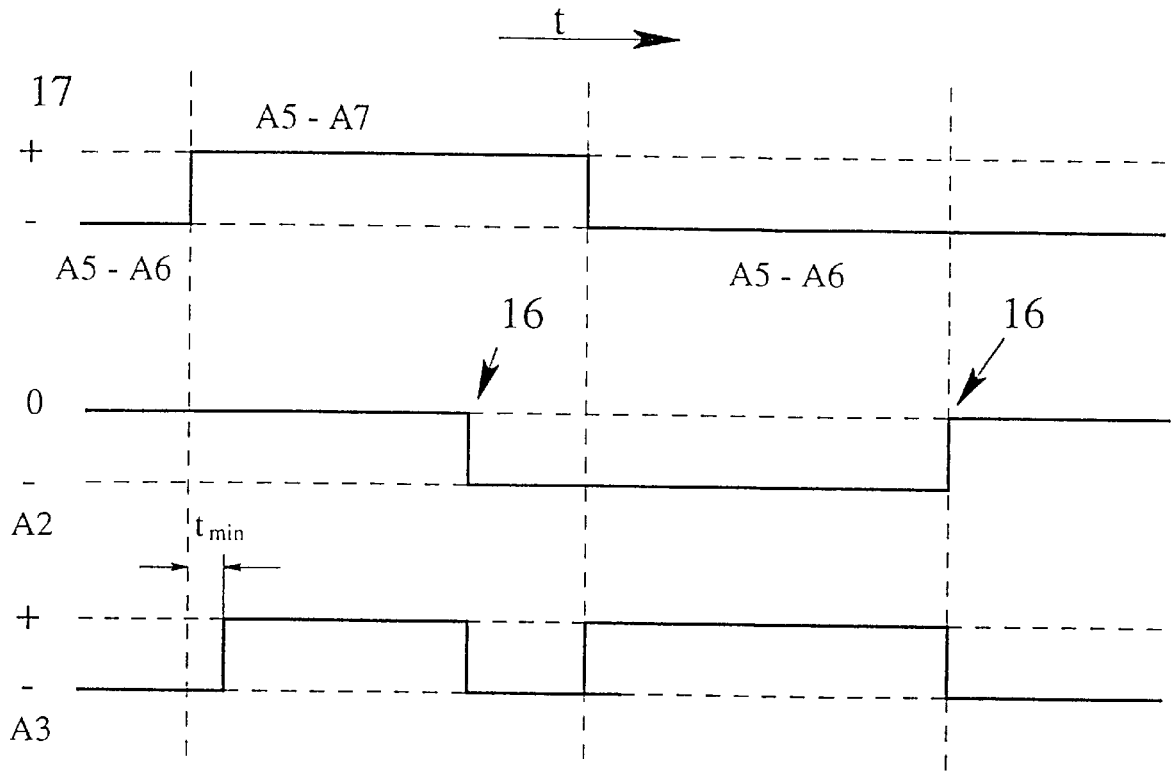
FIG. 3 are graphical representations of the voltage and signal behaviors in the circuit according to FIG. 2.

FIG. 3 shows the behavior of signals on the different terminals or switches. At the top is the curve of handle switch 17 initially for actuating handle 5 not actuated, with connection A5–A6, then for actuating handle 5 actuated, with connection A5–A7. Underneath is the behavior of the signal on terminal A2. At the bottom is the behavior of the signal on terminal A3for supplying power to drive 15.

If handle switch 17 is switched due to influence on the actuating handle 5, and kept in switch position A5–A7, power is supplied to the terminals as follows.

Terminal A3 is set to + after a minimum time $t_{min}$ has passed. Terminal A2 is interrogated and first shows signal 0. As soon as detent pawl switch 16 has responded, the signal on A2 jumps to − (The signal sequence can also be exactly reversed). As soon as A2 has switched to −, A3 is switched by control logic 23 to − and drive 15 is stopped. Now, if the actuating handle 5 is released, handle switch 17 switches from A5–A7 to A5–A6. This switching measure initiates a switching function for A3 (optionally also after minimum time $_{min}$ has passed again), where switching from − to + takes place and power is again supplied to terminal 15. The drive 15 continues to run until detent pawl switch 16 switches from − to 0 (or vice versa). Control logic 23 recognizes this change as reaching the readiness position and immediately switches A3 from + to − and drive 15 stops.

Since, in the embodiment shown, first of all, there is only detent pawl switch 16, it is essential that it scans only the position of cam 22, not the position of detent pawl 14 itself. Switching of detent pawl switch 16 can be thus be defined as drive 15 reaching the readiness position, regardless of the actual position of detent pawl 14.

If detent pawl switch 16, however, scans detent pawl 14 directly, it has not been actuated when detent pawl 14 is mechanically held in the open position. In this case, additional readiness position switch 18, as shown by the dotted line in FIG. 2, is required in order to then turn off drive 15 in the readiness position.

Figure 4:
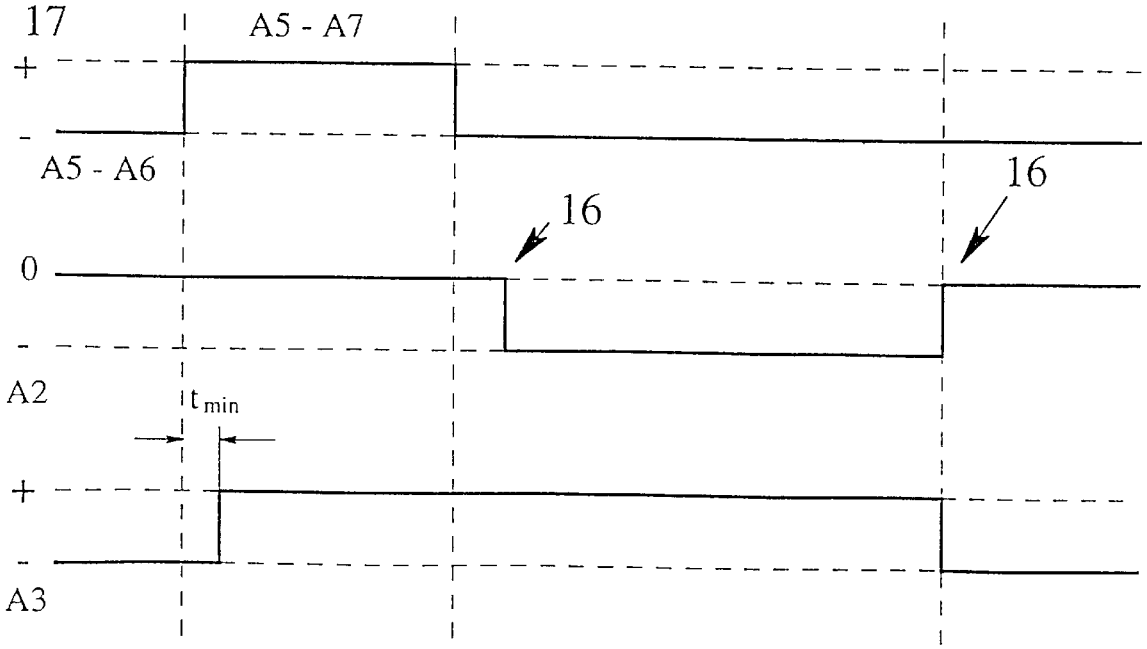
FIG. 4 show views corresponding to those of FIG. 3 for another cycle.

FIG. 4 shows the behavior of the signals in the above described circuit for the case in which actuating handle 5 is only briefly actuated, handle switch 17 is therefore actuated with a time greater than $t_{min}$, but shorter than necessary for opening. It is apparent that here switching to A2 for the signal on A3 remains ineffective, since the signal from handle switch 17 has already occurred again before that has occurred.

Evaluation of the signals on terminal A1 to rotary latch switch 20 by control logic 23 makes it possible to ascertain the actual open position of the motor vehicle door lock or the like in this circuit. Therefore, it can be ascertained whether, when cycling through the opening function, the motor vehicle door lock has in fact also mechanically opened or whether it was not able to open due to external influences (freezing of the seal, snow load, sticking of the seal, etc.). Interrogation of the rotary latch switch 20, therefore, allows integration of the so-called "snow load function" into the circuit.

Figure 2:
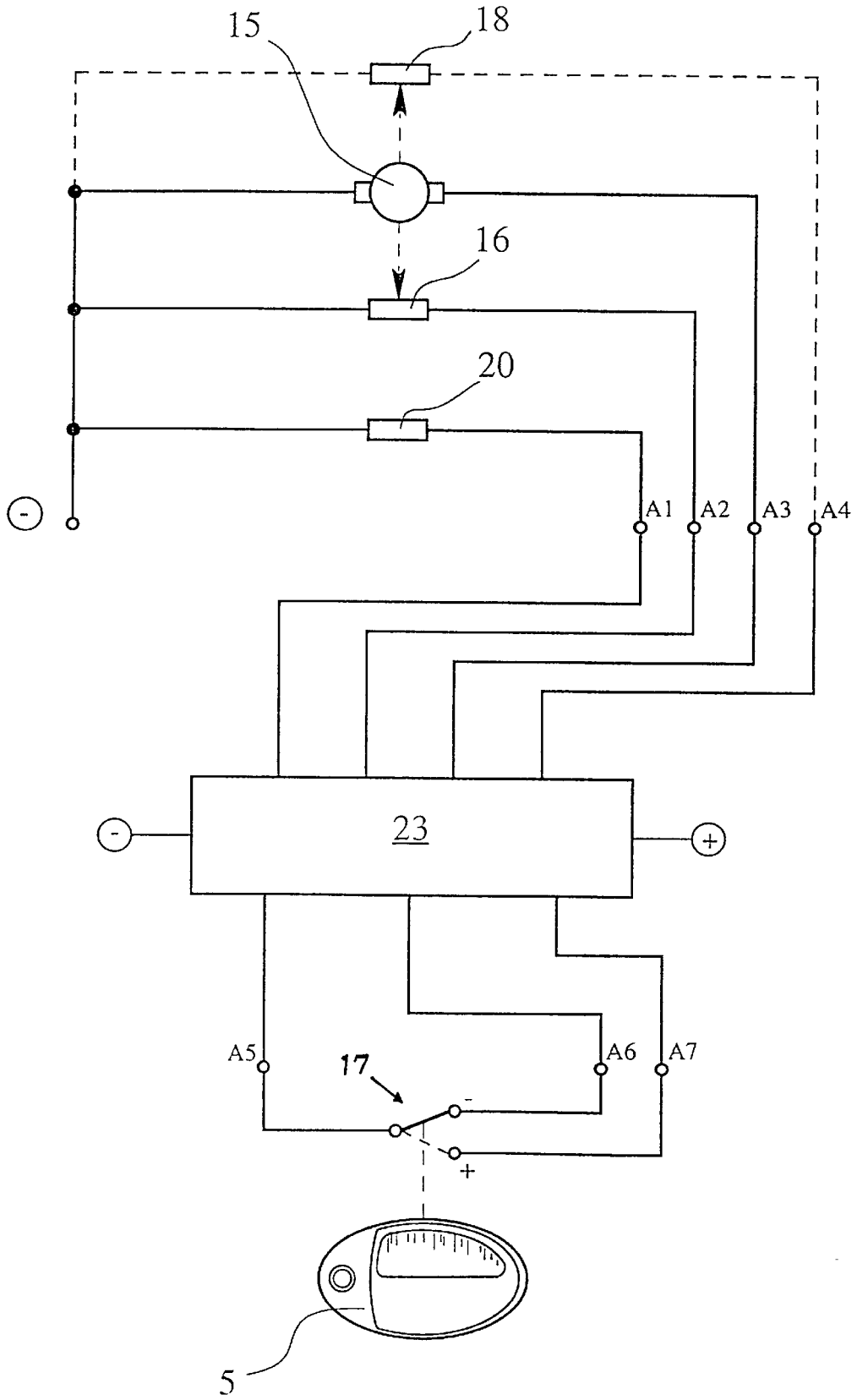
FIG. 2 is a diagrammatic depiction of a circuit according to the invention.

The circuit according to FIG. 2, explained above using the diagrams in FIGS. 3, 4, is especially suited when control logic 23 is a direct component of the motor vehicle door lock, since delay times in the control can therefore be ignored.

Figure 5:
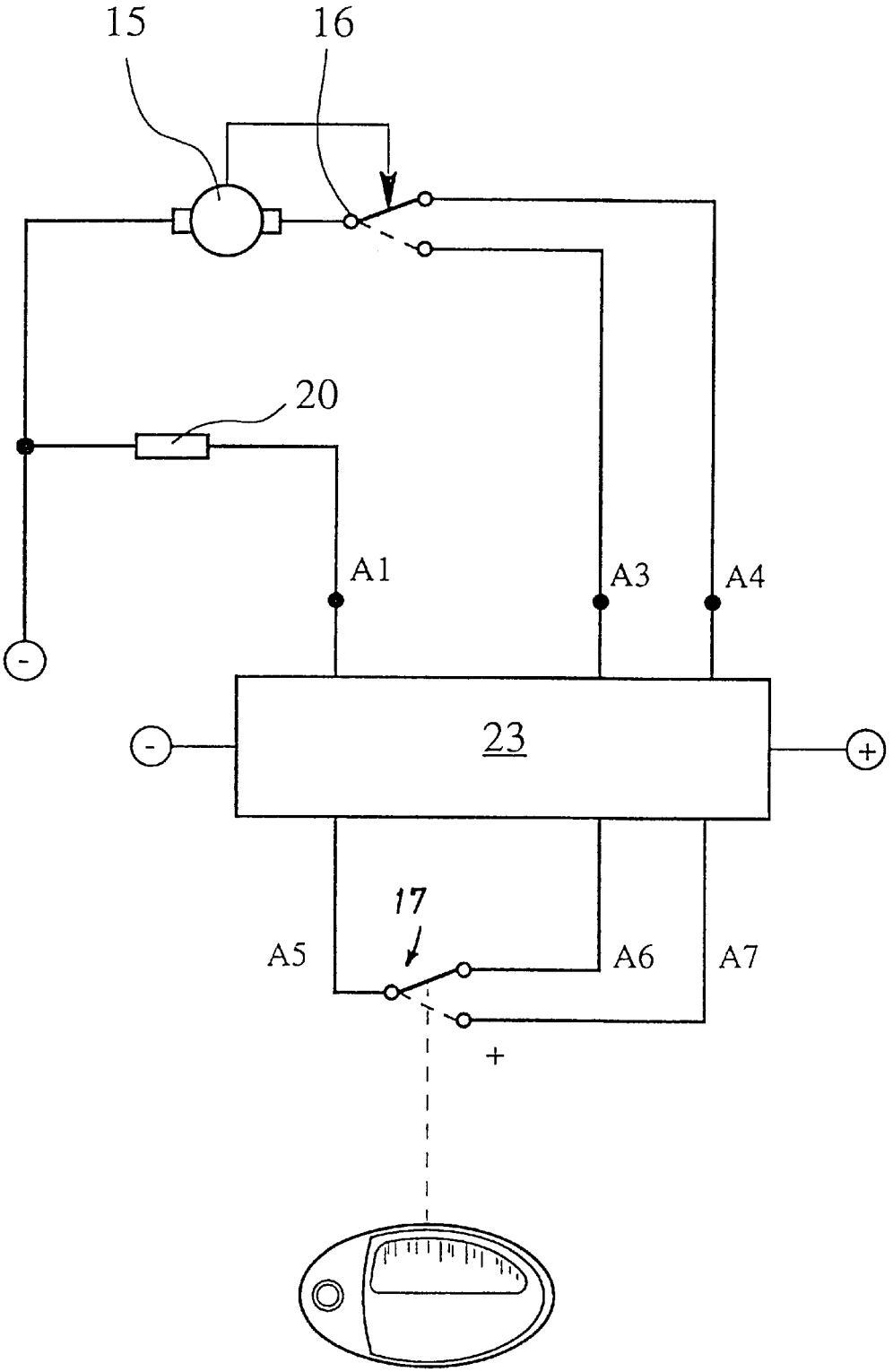
FIG. 5 is a view corresponding to that of FIG. 2, but illustrating an alternative embodiment.

The embodiment shown in FIG. 5, on the other hand, considers a partially decentralized automatic control which allows time delays to be considered, for example, by central control logic 23.

In the circuit from FIG. 5, first of all, the various terminals correspond to the like designated terminals in the circuit from FIG. 2, so that further explanations of these terminals are unnecessary. The circuit from FIG. 5 differs from the circuit from FIG. 2, firstly, in that the detent pawl switch 16 is made as a changeover switch which is located between the "+" terminal of drive 15 and terminals A3 and A4 to control logic 23. By means of detent pawl switch 16, therefore, drive 15 is connected to either terminal A3 or terminal A4. In this embodiment, the detent pawl switch 16 is not triggered from control logic 23, but directly by drive 15. FIG. 5 does not further illustrate that this switch need be connected in any way to + or −.

In this embodiment, furthermore, it is provided that the detent pawl switch 16 is actuated by an actuating element on drive 15, itself, when the cam 22 or the like is securely coupled to drive 15 to lift detent pawl 14. A cam control can also be used, separately from drive 15, to actuate detent pawl switch 16.

It is important for operation of circuit from FIG. 5 that the cycle, once started, runs until the readiness position is reached and shutoff takes place by detent pawl switch 16. This allows independence from control logic 23 and thus from the transit times in the system.

First of all, the following cycle applies:

When the actuating handle 5 is actuated and the handle switch 17 is maintained in the connection position A5–A7, power is supplied to the control logic 23 or the control logic 23 interrogates the terminals in the following manner:

A4: After passage of a minimum time $t_{min}$ switches to +,

Detent pawl switch 16 is made as a changeover switch and switches from position 15-A4 to position 15-A3 as soon as it is actuated.

A3: Is on − and remains on −,

A4: Jumps from + to − as soon as detent pawl switch 16 has switched to position 15-A3.

If the handle switch 17 is switched back by releasing of actuating handle 5, or in some other way, so that A5–A6 are connected, power is supplied to the control logic or it interrogates the terminals as follows:

A3: Switches from − to +.

The detent pawl switch 16 is made as a changeover switch and switches from position 15-A3 to position 15-A4 when the readiness position is reached.

A3: After switching from position 15-A3 to position 15-A4 and passage of a certain delay time $t_v$, switches from + to −.

Similar to the above explained embodiment, with premature release of actuating handle 5, another cycle can take place, specifically the following:

When actuating handle 5 is actuated and handle switch 17 is kept for the time being in connection position A5–A7, actuating handle 5 is then released again and handle switch 17 is switched back before detent pawl switch 16 has switched, then power is supplied to control logic 23 or it interrogates the terminals as follows:

A4: After passage of minimum time $t_{min}$, switches to +,

A3: As soon as handle switch 17 has switched back, switches over from − to + (optionally also after a minimum time $t_{min}$ has passed).

Detent pawl switch 16 is made as a changeover switch and switches from position 15-A4 to position 15-A3 as soon as it is actuated.

A4: Jumps from + to − as soon as detent pawl switch 16 has been switched to position 15-A3.

The detent pawl switch 16 switches from position 15-A3 to position 15-A4 when the readiness position is reached.

A3: After switching from position 15-A3 to position 15-A4 and a certain delay time $t_v$ has passed, from changes from + to −.

In both cases, it has proven feasible to make the delay time $t_v$ roughly 500 ms.

Of course, there are a host of possibilities for implementing the teaching according to the invention using circuitry. The above embodiments represent only preferred versions which are in no way to be understood as exclusive of others. The teaching of the invention is intended and suited for all types of door locks, not only for side door locks. Therefore, this invention is not limited to the details shown and described herein, and includes all such changes and modifications as are encompassed by the scope of the appended claims.

We claim:

1. Process for triggering an electrically actuated motor vehicle door lock of the type having an actuating handle, a rotary latch, a detent pawl for holding the rotary latch in a closed position, and an electric drive which is displaceable from an initial, rest position for shifting of the detent pawl, said detent pawl being raisable by the drive off of the catch of the rotary latch, at least one detent pawl switch for indicating a position of the detent pawl, and a handle switch for indicating an actuation state of the actuating handle, comprising the steps of:

triggering the drive by actuation of said actuating handle;

triggering a switching function only when actuation of the actuating handle is maintained for at least a predetermined minimum time;

always returning of the drive to the initial, rest position after actuation of the actuating handle has been terminated, even if such occurs in less than said predetermined minimum time; and turning off the drive upon returning of the drive to said initial rest position.

2. Process according to claim 1, comprising, prior to said turning off step, the further steps of first turning off the drive by actuating of the at least one detent pawl switch with the actuation by the actuating handle actuation and then turning the drive on again at the end of the actuation of the actuating handle by actuation of the handle switch, and then cycling the drive through to the initial rest position.

3. Process according to claim 2, wherein, when actuation of the actuating handle has been maintained beyond said predetermined minimum time, allowing the drive to proceed to a readiness position without the detent pawl switch having any effect on operation of the drive.

4. Process according to claim 1, wherein, when actuation of the actuating handle has been maintained beyond said predetermined minimum time, allowing the drive to proceed to a readiness position without the detent pawl switch having any effect on operation of the drive.

5. Process according to claim 1, wherein the electric drive is operable in only one direction.

6. Process according to claim 1, wherein the electric drive is self-locking.

7. Process according to claim 1, comprising the step of scanning at least one of the position and switching functions of the rotary latch with a rotary latch switch.

8. Process according to claim 1, wherein the detent pawl switch scans the position of a cam of the drive which raises the detent pawl instead of the position of detent pawl itself.

9. Process according to claim 1, wherein the detent pawl switch is actuated by an actuating element of the drive when a cam for lifting the detent pawl is securely coupled on a drive motor of the drive.

10. Process according to claim 1, wherein said predetermined minimum time is 15 to 40 ms.

11. Process according to claim 1, wherein said predetermined minimum time is about 25 ms.

12. Process according to claim 1, wherein the detent pawl switch scans the actual position of the detent pawl; and wherein a readiness position switch is switched when the drive returns to the initial, rest position.

13. Process according to claim 1, is performed at least in part by a control circuit having a control logic and in which the control logic is connected to terminals of a power supply as well as to the detent pawl switch, the drive, a common pole of the handle switch, a negative switch pole of the handle switch, and a positive pole of the handle switch.

14. In an electrically actuated motor vehicle door lock of the type having an actuating handle, a rotary latch, a detent pawl for holding the rotary latch in a closed position, and an electric drive which is displaceable from an initial, rest position for shifting of the detent pawl, said detent pawl being raisable by the drive off of the catch of the rotary latch, at least one detent pawl switch for indicating a position of the detent pawl, and a handle switch for indicating an actuation state of the actuating handle, a control logic and a power supply, a control circuit comprising:

a connection of the control logic to terminals of the power supply as well as to the detent pawl switch, the drive, a common pole of the handle switch, a negative switch pole of the handle switch, and a positive pole of the handle switch, a means for trigger the drive in response to actuation of said actuating handle, a means for trigger a switching function only when actuation of the actuating handle is maintained for at least a predetermined minimum time, a means for always returning of the drive to an initial, rest position after actuation of the actuating handle has been terminated, even if such occurs less than said predetermined minimum time, and a means for turning off the drive upon returning of the drive to said initial rest position.

15. In a door lock according to claim 14, wherein said control logic is also connected to a rotary latch switch.

16. In a door lock according to claim 14, wherein the detent pawl switch is a changeover switch and is located between a "+" terminal of drive and the terminals to the power supply and to the common pole of the handle switch.

17. Circuit according to claim 14, wherein the detent pawl switch is directly responsive to the position of the detent pawl; and wherein a readiness position switch is provided which is responsive to the drive reaching the initial rest position.

* * * * *